US007419515B2

(12) United States Patent
Olliges

(10) Patent No.: US 7,419,515 B2
(45) Date of Patent: Sep. 2, 2008

(54) MULTI-PHASE DISTILLATE FUEL COMPOSITIONS AND CONCENTRATES CONTAINING EMULSIFIED BORIC ACID

(75) Inventor: William E. Olliges, Palm City, FL (US)

(73) Assignee: Advanced Lubrication Technology, Inc., Agoura Hills, CA (US)

( * ) Notice: Subject to any disclaimer, the term of this patent is extended or adjusted under 35 U.S.C. 154(b) by 415 days.

(21) Appl. No.: 11/201,941

(22) Filed: Aug. 10, 2005

(65) Prior Publication Data

US 2007/0033862 A1 Feb. 15, 2007

(51) Int. Cl.
*C10L 1/12* (2006.01)
*C10L 1/32* (2006.01)
*C10L 1/18* (2006.01)

(52) U.S. Cl. ..... 44/314; 44/301; 44/302; 44/451; 44/452

(58) Field of Classification Search ..... 44/301, 44/302, 451, 452, 314
See application file for complete search history.

(56) References Cited

U.S. PATENT DOCUMENTS

| | | | | |
|---|---|---|---|---|
| 2,614,985 | A | 10/1952 | Cook | |
| 3,997,454 | A | 12/1976 | Adams | |
| 4,448,701 | A | 5/1984 | Duerksen et al. | |
| 4,626,367 | A | 12/1986 | Kuwamoto et al. | |
| 4,636,326 | A | 1/1987 | Hernandez | |
| 4,690,687 | A | 9/1987 | Johnston et al. | |
| 5,431,830 | A | 7/1995 | Erdemir | |
| 5,512,198 | A | 4/1996 | Sasaki et al. | |
| 5,739,088 | A | 4/1998 | Inoue et al. | |
| 5,877,129 | A | 3/1999 | Yatsuzukza et al. | |
| 6,025,306 | A | 2/2000 | Erdemir | |
| 6,245,723 | B1 | 6/2001 | Sigg | |
| 6,368,369 | B1 | 4/2002 | Sandiya et al. | |
| 6,472,352 | B1 | 10/2002 | Hacias | |
| 6,645,262 | B1 | 11/2003 | Sandiya et al. | |
| 6,783,561 | B2 | 8/2004 | Erdemir | |
| 2003/0045435 | A1 * | 3/2003 | Erdemir | 508/156 |
| 2004/0093789 | A1 * | 5/2004 | Hart et al. | 44/301 |
| 2005/0009712 | A1 | 1/2005 | Erdemir | |
| 2007/0033862 | A1 | 2/2007 | Olliges | |
| 2007/0037714 | A1 | 2/2007 | Olliges | |

FOREIGN PATENT DOCUMENTS

| | | | |
|---|---|---|---|
| DE | 19703085 | A1 | 7/1998 |
| EP | 0206833 | | 12/1986 |
| EP | 0403205 | A | 12/1990 |
| FR | 1559468 | | 3/1969 |
| GB | 1169667 | A | 11/1969 |
| GB | 1202386 | A | 8/1970 |

OTHER PUBLICATIONS

Jackson, M. M., et al., "Study of Diesel and Ethanol Blends Stability," SAE International, 2003.
GB-A 1 307 127; Milner, et al, Feb. 14, 1973.
GB-A2 091 291; Drew Chemical, Jul. 28, 1982.
EP-A-0 207 560; Shell, Jan. 7, 1987.
FR-A-2 277 881; Chevron (corresponding US Patent 3,997,454), Jul. 3, 1975.

* cited by examiner

*Primary Examiner*—Cephia D Toomer
(74) *Attorney, Agent, or Firm*—Cahn & Samuels, LLP.

(57) ABSTRACT

Disclosed is a multiphase fuel composition formed of an emulsion containing (a) a distillate fuel first phase, (b) a second phase formed of boric acid and a liquid that is a solvent for boric acid, but immiscible in the first phase, such as glycerol, and (c) a surfactant.

18 Claims, No Drawings

MULTI-PHASE DISTILLATE FUEL COMPOSITIONS AND CONCENTRATES CONTAINING EMULSIFIED BORIC ACID

BACKGROUND OF THE INVENTION

1. Field of the Invention

This invention relates to the chemical arts. In particular, this invention relates to distillate fuels, such as diesel fuels, containing boric acid.

2. Discussion of the Related Art

Diesel fuels find wide-spread use in diesel-powered engines. It is an advantage of such engines that they provide relatively high fuel economy. Such fuels normally contain up to as much as 40,000 ppm sulfur. The sulfur imparts several desirable properties to the fuels. For example, sulfur provides lubricity and the sulfur in diesel fuel provides for diesel fuel's ability to reduce wear on the contacting metal surfaces, particularly the fuel pumps and injectors, found in diesel-powered engines. However, sulfur suffers from serious disadvantages. It causes environmental problems in the form of high levels of sulfur dioxide and hazardous particulates in engine exhaust gases. Because of high sulfur dioxide and particulate emissions, diesel-powered engines are not widely used or permitted in many large cites.

Consequently, it is a desideratum to develop low-sulfur distillate fuel compositions and, in particular, low-sulfur diesel fuel compositions. For example, low-sulfur No. 2 diesel fuel currently contains about 500 ppm sulfur and numerous attempts have been made to further reduce the sulfur content to about 300 ppm sulfur or less. Unfortunately, removing the sulfur reduces the lubricating capacity of the diesel fuel, accelerating wear and adversely affecting fuel economy.

Boric acid is environmentally safe, inexpensive, and has an unusual capacity to enhance the antifriction and antiwear properties of sliding metal surfaces. Boric acid is a crystalline compound, insoluble in hydrocarbons such as distillate fuels. Various attempts have been made to form stable fuel compositions containing boric acid. For example, U.S. Pat. No. 6,783,561 to Erdemir discloses fuel compositions containing only about 30 to about 3000 ppm boric acid. The patent teaches that the boric acid should be in the form of nanometer-sized particles to form a stable fuel composition. U.S. Pat. No. 6,368,369, to Sanduja et al., discloses a liquid hydrocarbon fuel graft polymer-stabilized boric acid product, which can be used to make liquid hydrocarbon fuel concentrates, as well as subsequently blended to make a liquid hydrocarbon fuel containing boric acid.

However, there remains a need for stable boric acid containing distillate fuel compositions which reduce the wear and increase the fuel economy of diesel and other distillate fuel-powered engines. There remains a further need for distillate fuel concentrates that can be readily blended to make such distillate fuels. The invention meets these needs and provides related advantages as well.

SUMMARY OF THE INVENTION

Now in accordance with the invention there has found stable boric acid containing distillate fuel compositions which reduce the wear and increase the fuel economy of diesel and other distillate fuel-powered engines, as well as distillate fuel concentrates that can be readily diluted with distillate fuel to make such compositions. The multiphase distillate fuel compositions are formed of an emulsion containing (a) a first phase comprised of the distillate fuel, (b) a second phase containing boric acid and a liquid that is a solvent for boric acid, but immiscible in the first phase, and (c) a surfactant. The liquid can be an organic liquid, such as a lower alkyl polyol, preferably glycerol, ethyl acetate, acetone, and alcohols such as methanol, ethanol, 1-propanol, 2-methyl-1-propanol, and 3-methyl-1-butanol or an inorganic liquid, such as glacial acetic acid and water.

Representative distillate fuels include diesel fuel, jet fuel, kerosene, and mixtures of these fuels, with low sulfur diesel fuels being of especial importance. Representative organic liquids include lower alkyl polyols, with glycerol being preferred.

In some embodiments, the concentration of the first phase is from about 30 to about 70 wt. %, preferably from about 45 to about 55 wt. %, and the concentration of the second phase is from about 30 to about 70 wt. %, preferably from about 45 to about 55 wt. %, based on the weight of the fuel composition. And in some embodiments, the second phase contains from about 10 to about 25 wt. %, boric acid and from about 90 to about 75 wt. %, organic liquid, based on the weight of the second phase.

Typically, the final boric acid concentration in the distillate fuel composition will be in the range of from about 10 ppm to about 50,000 ppm and more preferably in the range of from about 30 ppm to about 5,000 ppm, based on the weight of the fuel composition. And in those embodiments where the distillate fuel is no. 2 diesel fuel, the boric acid concentration is typically in the range of from about 50 ppm to about 25,000 ppm and preferably in the range of from about 100 ppm to about 1500 ppm, based on the weight of the distillate fuel composition.

DESCRIPTION OF THE PREFERRED EMBODIMENTS

Particular embodiments of the invention are described below in considerable detail for the purpose of illustrating its principles and operation. However, various modifications may be made, and the scope of the invention is not limited to the exemplary embodiments described below. For example, while specific reference is made to a distillate fuel composition concentrate, which is subsequently blended with additional distillate fuel, it will be understood that a second phase can be initially added to the distillate fuel in the final concentration.

The multiphase fuel composition in accordance with the invention is formed of an emulsion containing (a) a distillate fuel first phase, (b) a second phase formed of boric acid and a liquid that is a solvent for boric acid, but immiscible in the first phase, such as glycerol, and (c) a surfactant.

Representative distillate fuels for use as the first phase include diesel fuel and, in particular, low sulfur (i.e., less than 0.05 mass percent sulfur) diesel fuel, jet fuel, kerosene, and mixtures of these fuels. The distillate fuel, itself, may be a conventional petroleum distillate or may be synthesized, e.g., by the Fischer-Tropsh method or the like.

The boric acid useful in forming the second phase typically has a particle size of 100 microns or less, preferably of 65 microns or less. In more preferred embodiments, the boric acid has a particle size in the range of from about 0.1 to about 2.5 microns, still more preferably in the range of from about 0.5 to about 1 micron. The preferred boric acid particles are advantageously produced by the low temperature jet-milling of commercially available boric acid.

Suitable liquids that are solvent for boric acid, but immiscible in the first phase must be compatible with the distillate fuel and the distillate fuel composition's operation in an engine. The liquids can be either organic or inorganic. Representative organic liquids include lower alkyl polyols. Lower alkyl polyols useful in forming the second phase typically contain from three to seven carbon atoms and at least three hydroxyl groups. The preferred lower alkyl polyol is glycerol. Other suitable organic liquids include ethyl acetate, acetone, and alcohols such as methanol, ethanol, 1-propanol, 2-methyl-1-propanol, and 3-methyl-1-butanol. Suitable inorganic liquids include glacial acetic acid and water.

The amount of boric acid in the second phase is dependent on the solubility of the boric acid. It is generally desirable to add sufficient boric to saturate the second phase. Typically, the second phase contains from about 10 to about 25 wt. %, boric acid and from about 90 to about 75 wt. %, liquid, based on the weight of the second phase.

Suitable surfactants for the inventive distillate fuel compositions include tristyrylphenol ethoxylates, for example Soprophor TS-10 (Rhone Poulenc S. A.) or BSU (Rhodia Geronazzo Spa), EO/PO/EO block copolymers, for example Pluronic F-108, Pluronic F-38, Pluronic P-105 (BASF Wyandotte Corp.), and/or sodium salts of sulfonated naphthalene-sulfonic acid-formaldehyde condensation products, for example Morwet D-425 (Witco Chem. Corp.) or Orotan SN (Rohm & Haas, France S. A.), lignosulfonates, PO/EO butanol copolymers, for example Atlox G-5000, block copolymers of polyhydroxystearic acid and polyalkylene glycols, for example Atlox 4912 or 4914 (Uniqema), or partially hydrolysed or fully hydrolysed polyvinyl acetate, for example Mowiol 18-88 or Mowiol 4-88 (Hoechst AG).

It is most efficient to initially prepare a distillate fuel composition containing a relatively high concentration of the second phase in the distillate fuel. The amount of distillate fuel in such a concentrate is generally from about 30 to about 70 wt. %, preferably from about 45 to about 55 wt. %, based on the weight of the concentrate. The amount of the second phase in such a concentrate is generally from about 30 to about 70 wt. %, preferably from about 45 to about 55 wt. %, based on the weight of the concentrate. Such a concentrate contains the surfactant in an amount sufficient to stabilize the first and second phases, generally from about 0.5 to about 1.5 wt. %, based on the weight of the concentrate.

The concentrate can then be diluted with additional distillate fuel to obtain the final desired concentration. The concentration of boric acid in the finished fuel composition will depend on the particular fuel and the particular engine system. Typically, however, the final boric acid concentration will be in the range of from about 10 ppm to about 50,000 ppm, and more preferably in the range of from about 30 ppm to about 5,000 ppm, based on the weight of the fuel composition. For example, the boric acid concentration in no. 2 diesel fuel is preferably in the range of from about 50 ppm to about 25,000 ppm, and more preferably in the range of from about 100 ppm to about 1500 ppm, based on the weight of the finished distillate fuel composition.

The distillate fuel compositions can contain other conventional fuel additives. Representative additives include antioxidants, metal passivators, rust inhibitors, dispersants, detergents, and the like. The distillate fuel compositions also can contain additional lubricity-enhancing agents, such as stearic acid.

The lubricant compositions of this invention are made by mixing the boric acid, the liquid, and the surfactant in a high shear blender until a homogeneous mixture is obtained. Optionally, at this time, other conventional fuel additives can be added. Generally, the ingredients are blended at a temperature of about 150° F. However, the blending can also be done also at higher and lower temperatures, with higher temperatures being preferred to lower temperatures, because of the ease of forming the homogeneous solution. The mixture is then slowly cooled to room temperature.

To this mixture is slowly added the distillate fuel, either in an amount to form a concentrate or to form the distillate fuel composition. During the addition and, preferably, for a time after, the multiphase composition is mixed with a high shear blender until a stable emulsion is formed.

The foregoing example is intended to further illustrate the invention and is not a limitation thereon.

EXAMPLE

Following is an example of multi-phase distillate fuel concentrate containing 10 wt. % boric acid.

Glycerol (39.5 g) is heated to about 150 F. and boric acid (10 g) is added. At this temperature, the glycerol/boric acid mixture becomes nearly clear. The mixture is slowly cooled to room temperature. Because the glycerol is fully saturated with boric acid, the mixture develops an amber appearance. To this mixture is added Atlox 4912 (1.5 g) (Uniqema) surfactant and mixed in a high shear blender until no individual particles of the surfactant are seen.

Low sulphur diesel fuel (49.5 g) is then slowly added (1%/wt. %/min.) to the glycerol/boric acid phase and intimately blended using a high shear mixer. After all the low sulfur diesel fuel has been added, the mixture is mixed in the high-shear blender to complete the preparation of the multiphase distillate fuel concentrate. One quart of the concentrate can be added to 250 gallons of low sulfur diesel fuel produce a final multi-phase fuel composition containing 100 ppm boric acid.

While various embodiments of the present invention have been described above, it should be understood that they have been presented by way of example only, and not limitation. It will be understood by those skilled in the art that various changes in form and details can be made therein without departing from the spirit and scope of the invention as defined in the appended claims. Thus, the breadth and scope of the present invention should not be limited by any of the above-described exemplary embodiments, but should be defined only in accordance with the following claims and their equivalents.

I claim:

1. A multiphase distillate fuel composition comprising:

an emulsion containing (a) a first phase comprised of a distillate fuel;

(b) a second phase, the second phase comprised of (i) boric acid and (ii) an organic liquid that is a solvent for boric acid, but immiscible in the first phase; and (c) a surfactant, wherein the concentration of boric acid is from about 5 wt. % to about 17.5 wt. %, based on the weight of the fuel composition.

2. The multiphase distillate fuel composition in accordance with claim 1 wherein the organic liquid that is a solvent for boric acid, but immiscible in the first phase is a lower alkyl polyol, acetate, acetone, methanol, ethanol, 1-propanol, 2-methyl-1-propanol, or 3-methyl-1-butanol.

3. The multiphase distillate fuel composition in accordance with claim 2 wherein the organic liquid that is a solvent for boric acid, but immiscible in the first phase is glycerol.

4. The multiphase distillate fuel composition in accordance with claim 1 wherein the second phase contains from about 10 to about 25 wt. %, boric acid and from about 90 to about 75 wt. %, liquid, based on the weight of the second phase.

5. The multiphase distillate fuel composition in accordance with claim 1 wherein the distillate fuel is diesel fuel, jet fuel, kerosene, and mixtures thereof.

6. The multiphase distillate fuel composition in accordance with claim 1 wherein the distillate fuel is low sulfur diesel fuel.

7. The multiphase distillate fuel composition in accordance with claim 1 wherein the concentration of the first phase is from about 30 to about 70 wt. %, and the concentration of the second phase is from about 30 to about 70 wt. %, based on the weight of the fuel composition.

8. The multiphase distillate fuel composition in accordance with claim 1 wherein the concentration of the first phase is from about 45 to about 55 wt. %, and the concentration of the second phase is from about 45 to about 55 wt. %, based on the weight of the fuel composition.

9. A multiphase distillate fuel composition comprising:

an emulsion containing (a) a first phase comprised of diesel fuel, jet fuel, or kerosene;

(b) a second phase, the second phase comprised of (i) boric acid and (ii) glycerol; and (c) a surfactant, wherein the concentration of boric acid is from about 5 wt. % to about 17.5 wt %. based on the weight of the fuel composition.

10. The multiphase distillate fuel composition in accordance with claim 9 wherein the distillate fuel is low sulfur diesel fuel.

11. A multiphase distillate fuel composition comprising:

an emulsion containing (a) a first phase comprised of a low sulfur diesel fuel;

(b) a second phase, the second phase comprised of (i) boric acid and (ii) an organic liquid that is a solvent for boric acid, but immiscible in the first phase; and (c) a surfactant, wherein the concentration of boric acid is from about 5 wt. % to about 17.5 wt. %. based on the weight of the fuel composition.

12. A multiphase distillate fuel composition according to claim 1, wherein the boric acid has a particle size of less than 65 microns.

13. A multiphase distillate fuel composition according to claim 1, wherein the boric acid has a particle size of about 2.5 microns to 65 microns.

14. A multiphase distillate fuel composition according to claim 1, wherein the boric acid has a particle size of about 0.5 to about 1 micron.

15. A multiphase distillate fuel composition according to claim 1, comprising about 0.5 to about 1.5 wt. % surfactant based on the weight of the fuel composition.

16. A multiphase distillate fuel composition according to claim 1, wherein the surfactant is selected from the group consisting of tristyrylphenol ethoxylates, EO/PO/EO block copolymers, sodium salts of sulfonated naphthalenesulfonic acid-formaldehyde condensation products, lignosulfonates, PO/EO butanol copolymers, block copolymers of polyhydroxystearic acid and polyalkylene glycols, and partially hydrolysed or fully hydrolysed polyvinyl acetate.

17. A multiphase distillate fuel composition according to claim 1, wherein the surfactant comprises PO/EO butanol copolymers or block copolymers of polyhydroxystearic acid and polyalkylene glycols.

18. A multiphase distillate fuel composition according to claim 1, wherein the boric acid has a particle size of 65 microns to 100 microns.

* * * * *